US007690068B2

(12) United States Patent
Tagliaferri

(10) Patent No.: US 7,690,068 B2
(45) Date of Patent: Apr. 6, 2010

(54) PROTECTIVE STRUCTURE FOR BRUSHES OF SWEEPING MACHINES

(75) Inventor: Fabrizio Tagliaferri, Trecasali (IT)

(73) Assignee: Dulevo International, S.p.A., Sanguinaro di Fontanellato (Parma) (IT)

( * ) Notice: Subject to any disclaimer, the term of this patent is extended or adjusted under 35 U.S.C. 154(b) by 112 days.

(21) Appl. No.: 11/543,412

(22) Filed: Oct. 5, 2006

(65) Prior Publication Data

US 2007/0079457 A1 Apr. 12, 2007

(30) Foreign Application Priority Data

Oct. 7, 2005 (EP) ..... 05425700

(51) Int. Cl.
*E01H 1/04* (2006.01)

(52) U.S. Cl. ..... 15/87; 15/78; 15/257.01

(58) Field of Classification Search ..... 15/87, 15/78, 79.2, 340.1, 257.01, 49.1
See application file for complete search history.

(56) References Cited

U.S. PATENT DOCUMENTS 3,186,021 A * 6/1965 Krier et. al. ..... 15/340.4
5,991,953 A * 11/1999 Durenberger et al. ..... 15/83
6,018,844 A * 2/2000 Basham et al. ..... 15/349
6,073,295 A * 6/2000 Durenberger et al. ..... 15/83
6,507,968 B1 * 1/2003 Hansen ..... 15/49.1
7,025,834 B2 * 4/2006 Joynt et al. ..... 134/21
2005/0060834 A1 3/2005 Strauser

FOREIGN PATENT DOCUMENTS

DE 716 035 B1 1/1942
EP 0 990 737 A1 4/2000
WO WO 92/10614 A1 6/1992

* cited by examiner

*Primary Examiner*—Dung Van Nguyen
(74) *Attorney, Agent, or Firm*—R. Ruschena Patent Agent, LLC

(57) ABSTRACT

The invention relates a protective structure for brushes of sweeping machines (30) having a frame (31) and at least one cup-shaped brush (20) supported protruding from the frame (31), said structure (1) comprising a flexible membrane (2), positioned near the cup-shaped brush (20) and suitable to prevent the diffusion of dust in the environment, and a supporting system (3) for the flexible membrane (2), the supporting system (3) being movably connected to the sweeping machine and comprising a movable portion (6) which shapes the flexible membrane (2) and elastically deforms near the frame (31) counter to elastic means (9).

7 Claims, 3 Drawing Sheets

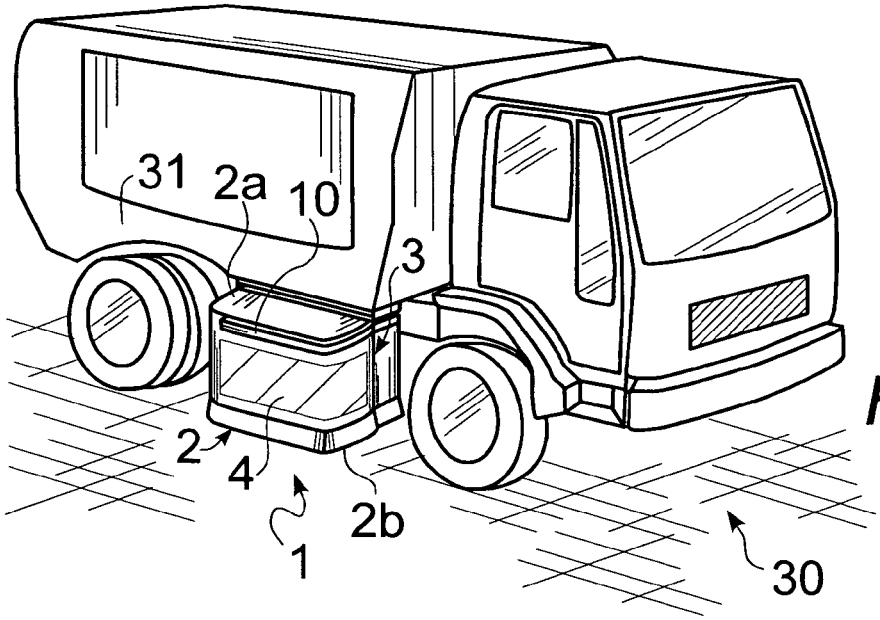
Fig. 1a
Fig. 1b
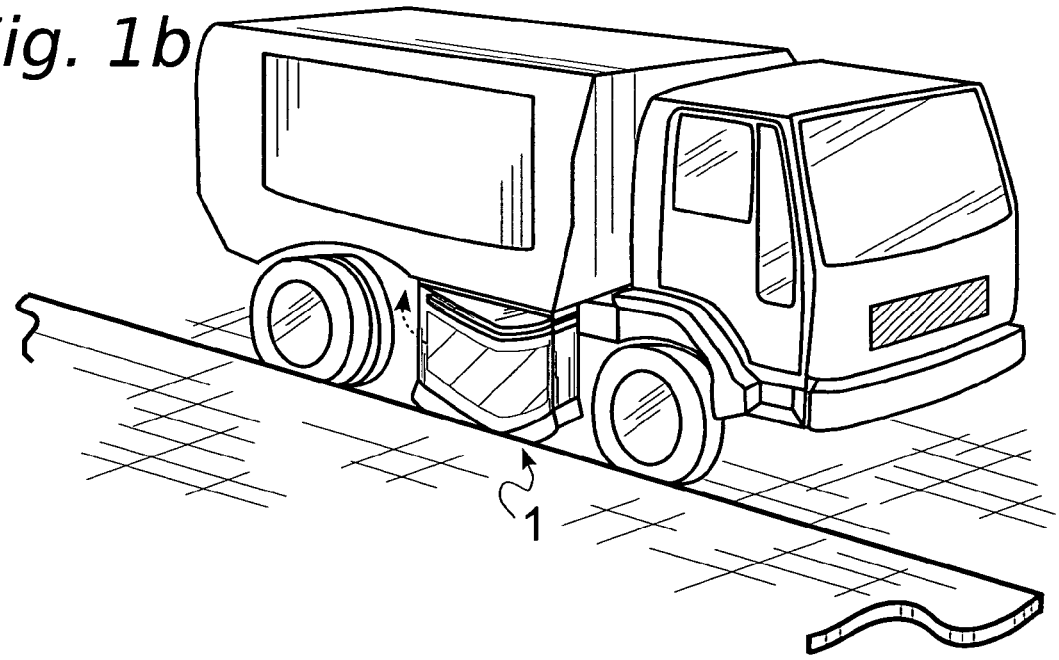

PROTECTIVE STRUCTURE FOR BRUSHES OF SWEEPING MACHINES

FIELD OF THE INVENTION

The present invention relates to a protective structure for brushes of sweeping machines, having a frame and at least one cup-shaped brush supported by the frame and protruding from the frame, the protective structure comprising at least one flexible membrane arranged near the cup-shaped brush and suitable to prevent the diffusion of dust in the environment.

DESCRIPTION OF THE PRIOR ART

As it is known, various types of sweeping machines for roads, industrial plants, workshops and other are currently available on the market.

Said machines are usually provided with cup-shaped, i.e. truncated cone-shaped, brushes.

The cup-shaped brushes are positioned frontally and laterally to the suction devices. They collect the dust and waste from the ground and send them to a suction system or a conveying device or similar, which stores them in a container provided for the purpose.

The action of the brushes can be assisted by a liquid (water or other), or they can operate dry.

Dry cleaning obviously results in a simpler machine due to the absence of water tanks and related piping systems. Dry cleaning is therefore often used.

The technique of dry cleaning nevertheless has an important drawback: the brushes raise large quantities of dust which is not completely absorbed by the sweeping machine and is therefore partially released to the environment.

This drawback can make the dry sweeping machine unserviceable, in particular if it has to be used for cleaning particularly dusty industrial plants, for example construction plants, cement works, engineering workshops and others.

An attempt has already been made to remedy said drawback by using protective covers for the brushes.

Said covers consist substantially of sheets that amply cover the brushes from the top right down to the ground.

The covers described also have several drawbacks, however.

They make it difficult to access the brushes for cleaning, setting, repair or replacement. It is known, in fact, that the brushes used in the sweeping machines require considerable maintenance and frequent replacements.

Furthermore said sweeping machines frequently use the cup-shaped brushes against curbs or side walls, exploiting the flexibility of the bristles of said brushes which temporarily deform against the curb or side wall and vigorously clean the edge defined by said curb or side wall.

This operation is difficult due to the presence of covers, in particular if the same are supported by a rigid framework, which can permanently deform if it is pushed against a kerb or a wall.

Said covers furthermore hide the brushes below, so that the operator in charge of cleaning is not able to control the path followed by the brush or ascertain the condition of the brush.

Furthermore said covers wear rapidly, in particular where they come into contact with the ground and their replacement is long and laborious.

Last but not least, a further drawback is the fact that the covers increase the lateral overall dimensions of the sweeping machine obstructing the passage of the same through narrow spaces and similar. In fact it is known that the cup-shaped brushes are pressed against the ground during use, considerably increasing their base surface. The covers must therefore take account of this considerable external encumbrance, which remains even when the brushes are in the rest position.

SUMMARY OF THE INVENTION

In this situation the technical task underlying the present invention is to conceive a protective structure for brushes of sweeping machines able to substantially remedy the above-mentioned drawbacks.

In the context of said technical task an important aim of the invention is to produce a protective structure for brushes of sweeping machines that permits rapid and easy access to the brushes for maintenance operations and similar.

Another important aim of the invention is to produce a protective structure with reduced overall dimensions in situations of interference with obstacles.

A further aim of the present invention is to conceive a protective structure for brushes of sweeping machines that permits identification of the position of and path followed by the brushes below.

Another important aim of the invention is furthermore to produce a protective structure for brushes of sweeping machines which is easily replaceable.

The technical task and the aims specified are achieved by a protective structure for brushes of sweeping machines, the sweeping machine having a frame and at least one cup-shaped brush supported by the frame and protruding from the frame, the protective structure comprising: at least one flexible membrane arranged near the cup-shaped brush and suitable to prevent the diffusion of dust in the environment and a supporting system for the flexible membrane on the frame, and the supporting system being movably connected to the frame and comprising a movable portion suitable to shape the flexible membrane and to translate the same near to the frame counter to elastic means.

BRIEF DESCRIPTION OF THE DRAWINGS

Further features and advantages of the invention are clarified better below by the detailed description of a preferred embodiment of the invention, with reference to the attached drawings, in which:

FIG. 1*a* shows the protective structure according to the invention applied on a sweeping machine;

FIG. 1*b* shows the protective structure according to the invention during a particular use applied on a sweeping machine;

DESCRIPTION OF THE PREFERRED EMBODIMENTS

Figure 2:
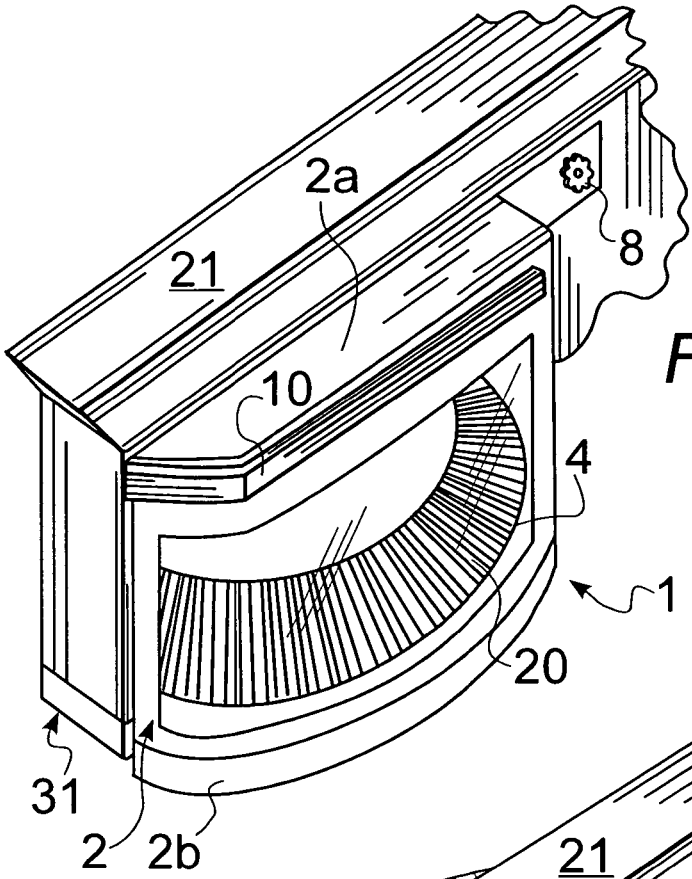
FIG. 2 shows a detail of the structure according to the invention.
Figure 3:
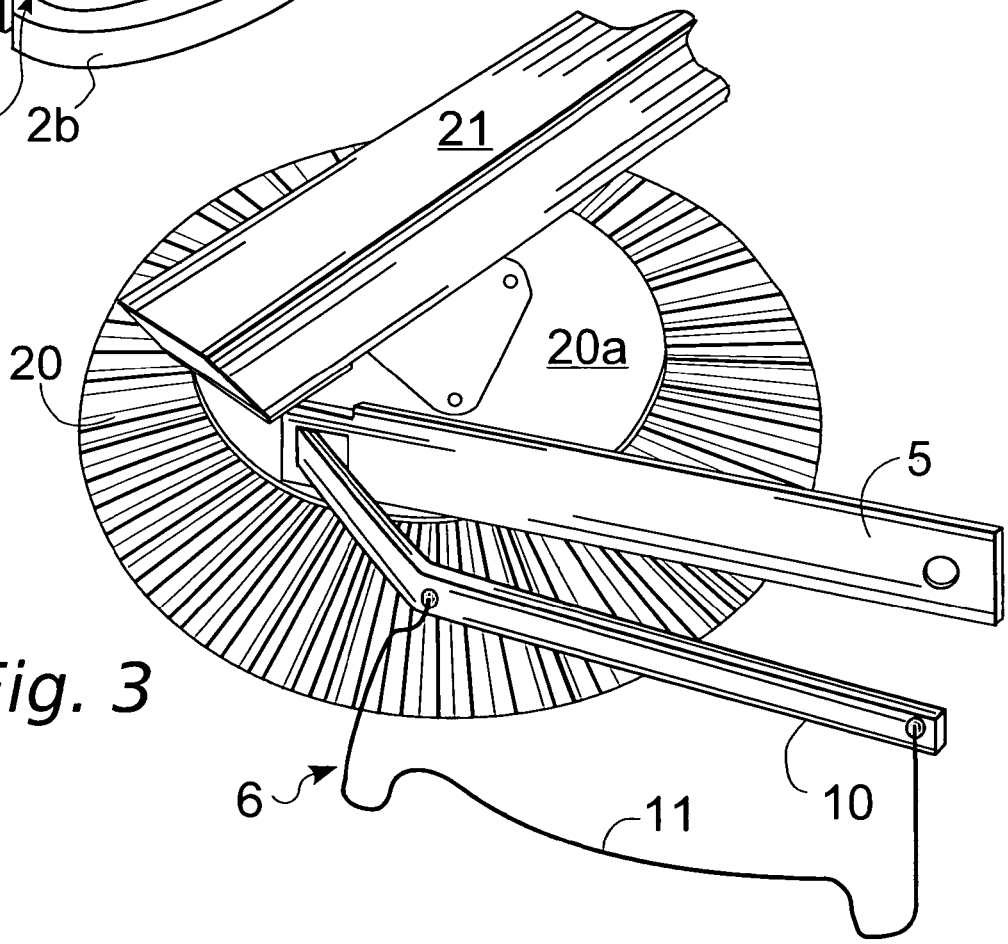
FIG. 3 highlights the maintenance of a detail of the structure according to the invention.

With reference to the Figures quoted, the protective structure according to the invention is indicated overall by the number 1.

It is used in sweeping machines for roads, building sites and similar and in particular on a sweeping machine 30 that operates by dry cleaning, i.e. without cleaning liquids.

The structure 1 is suitable to prevent diffusion in the environment of dust and similar which is moved by the circular truncated cone-shaped brushes 20, called cup-shaped brushes.

These brushes are supported by a frame 31 or similar, part of the sweeping machine 30.

The cup-shaped brushes 20 consist of a rigid circular support 20*a* which sustains bristles or hairs running towards the ground and defining, expanding from said rigid support, a truncated cone-shaped volume. Said bristles or hairs are pressed against the ground during use of said brush 20, with the effect of expanding the surface of the brush 20.

The structure 1 is positioned near the brushes 20 which operate in said sweeping machines, in particular near the cup-shaped brushes 20 arranged laterally and externally to the frame 31, as shown in (FIG. 2).

The structure 1 comprises a flexible membrane 2 made of fabric or polymeric material, which envelops the outer portion of the brush 20, as shown in FIG. 2.

Said membrane 2 is sustained by a supporting system 3.

The membrane 2 is connected to the supporting system 3 in its upper part 2*a*, extends down to the surface of the ground and comes into contact with the ground in its lower part 2*b*.

It consists at least partially of a transparent membrane 4, consisting of transparent polymeric material or similar. Said transparent membrane 4 is preferably located near the lower part 2*b* and at the front with respect to the direction of movement of the brush, thus allowing the operator to see the fundamental part of the brush 20, i.e. the part in contact with the ground and the part immediately above.

Furthermore the lower part 2*b* can preferably be separated from the membrane 2, to which it is connected by movable connections such as Velcro, buttons or similar.

The supporting system 3 is joined by means of a movable connection to a segment 21, such as a longitudinal member or similar, part of the frame 31 of the sweeping machine 30. By the term movable connection we mean a connection that can be easily removed, such as a screw, a hook, a handwheel or similar.

Said supporting system 3 comprises a fixed portion 5 and a movable portion 6.

The fixed portion 5 is suitable to connect the flexible membrane 2 to the sweeping machine: the flexible membrane 2 is connected, by means of screws or similar, to the fixed portion 5 above the brush 20.

The fixed portion 5 consists preferably of a rigid lamina arranged substantially parallel to the segment 21.

Said fixed portion 5 is advantageously connected to the segment 21 by means of a fixed hinge 7*a* which, in the absence of other connections, permits rotational movements with axis substantially perpendicular to the plane formed by the ground, and a locking element 8, which prevents said rotation of the fixed part 5. The rotation movement described can therefore be activated by disengaging the locking element 8 (FIG. 2).

Said locking element 8 can consist of a handwheel, an elastic release element or similar. If the locking element 8 consists of a handwheel connected to a screw, the fixed portion 5 has a recess or similar for insertion of the screw shaft. In said case, furthermore, a lock nut or similar is preferably arranged on the screw to adjust the tightening position of the fixed portion 5.

The locking element 8 and the fixed hinge 7*a* are preferably arranged on opposite ends of the supporting system 3.

Alternatively the fixed portion 5 is connected to the segment 21 by means of two handwheels, two screws or similar.

The movable portion 6 extends outside the sweeping machine and is suitable to give the flexible membrane 2 the appropriate shape and position. The position at a short distance from the brush 20 is called the work position.

The movable portion 6 is furthermore suitable to position itself, if pressed, alongside the frame 31.

In particular the movable portion 6 is fixed at one end to the segment 21 by means of a free hinge 7*b*.

Figure 4:
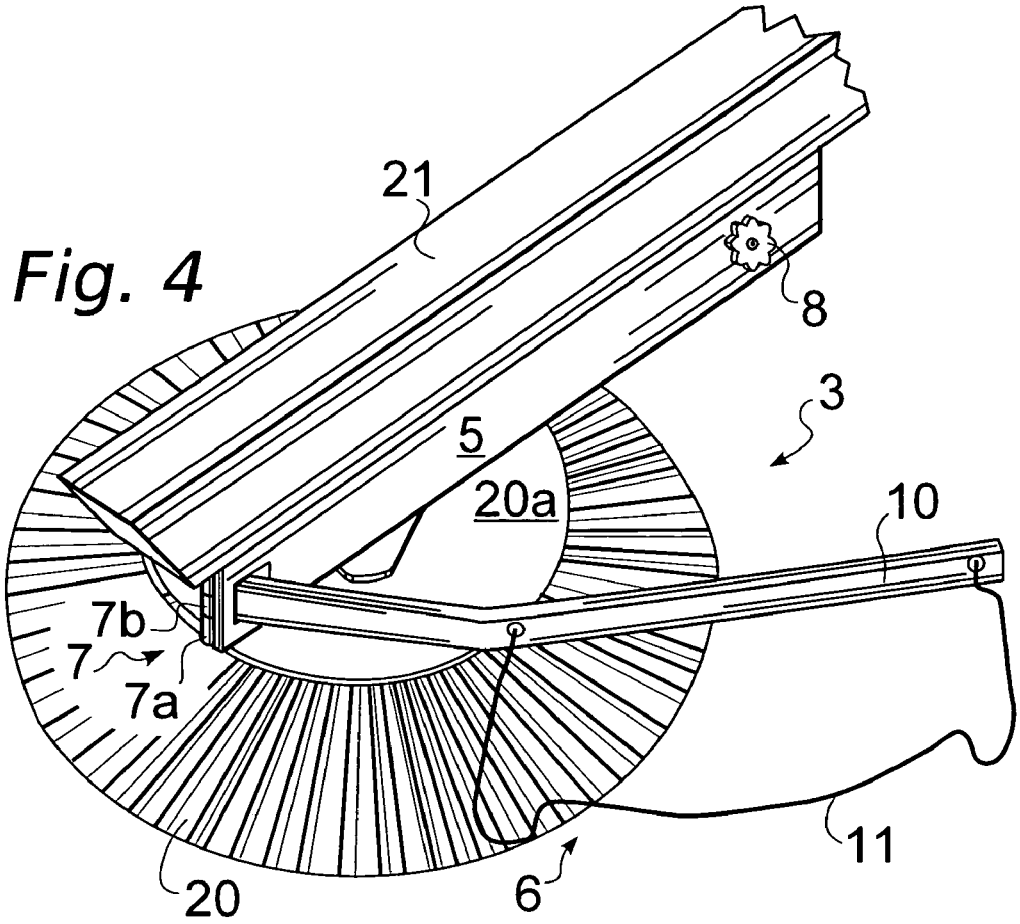
FIG. 4 shows an overhead view of a detail according to the invention.

The free hinge 7*b* and the fixed hinge 7*a* can be appropriately arranged on one single pin (FIG. 4) and permit independent rotations of the fixed part 5, the movable part 6 and the segment 21.

No other fixed connections are present on the movable portion 6, and the same can therefore rotate in the direction permitted by the free hinge 7*b*.

Elastic means 9 (FIG. 5) are present which re-set the movable portion 6 to the work position.

Figure 5:
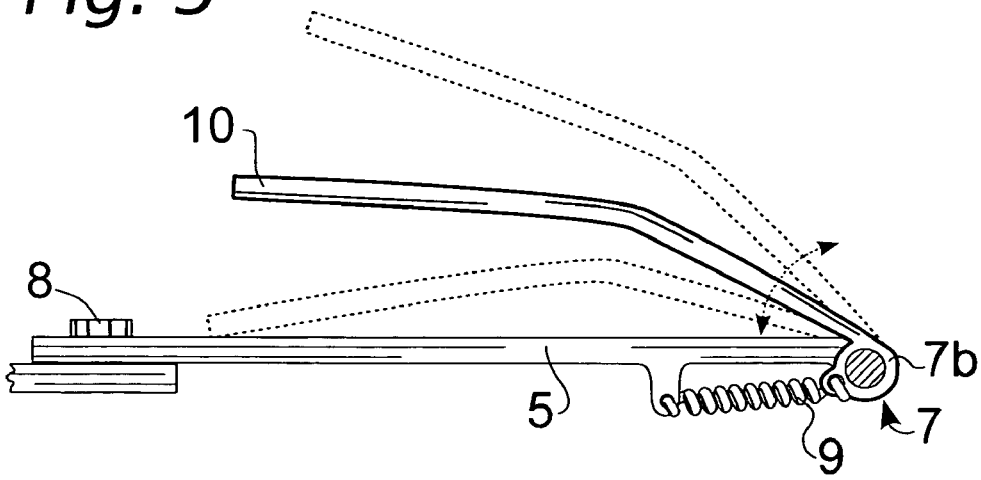
FIG. 5 shows a cleaning machine featuring said covers.

Said elastic means 9 can consist, as illustrated in FIG. 5, of a spring integral at one end with the fixed portion 5 and at the other end with the free hinge 7*a*. Said elastic means 9 create forces that counter the rotation of the movable portion 6 in both directions of rotation.

The movable portion 6 consists preferably of an oscillating arm 10 to which a supporting element 11 is connected, preferably consisting of a semi-rigid element, more preferably a tubular steel element.

Said supporting element 11 gives the flexible membrane 2 the appropriate shape.

The upper part 2*a* of the membrane 2 can be conveniently connected to the oscillating arm 10 by means of screws, hooks or a pocket purposely arranged on the flexible membrane 2, in which the oscillating arm 10 is inserted.

The membrane 2 is therefore supported above the brush 20, in particular by the fixed portion 5 and the oscillating arm 10. From here it is left free from fixed connections and, by gravity, falls back down onto the supporting element 11, which appropriately positions the membrane 2 at a short distance from the brush 20. Lastly, the membrane 2 drops back onto the ground and comes into contact with the same in its end part.

The outer part of the brush 20 is therefore completely covered by the membrane 2. Operation of the protective apparatus 1, structurally described above, is as follows. The apparatus 1 is arranged preferably around each cup-shaped brush 20 of the sweeping machine which operates dry. More precisely the apparatus 1 is positioned around the outer portion of the lateral brushes 20, i.e. around the portion of brushes that protrudes from the profile of said sweeping machines.

For positioning of the apparatus 1 the only elements to be connected to the sweeping machine are the hinges 7*a* and 7*b*, appropriately housed on one single pin, and the locking element 8.

When the sweeping machine is operating, the brushes 20 begin to rotate to convey the dust and waste into a container provided for the purpose.

During operation the brushes 20 raise dust and similar which, however, is not released to the environment because if it is not sucked in by the sweeping machine, it is pushed back by the apparatus 1.

The apparatus 1 entirely covers the outer part of the brush 20, as previously described, thus preventing the dust from flowing out into the environment.

During use of the machine the operator can continuously check the position and condition of the brushes 20 despite the presence of the membrane 2. In fact, the transparent membrane 4 is present.

If the brushes require maintenance or replacement it is sufficient to remove the locking element 8, i.e. manually unscrew the handwheel, to rotate the fixed portion 5 around the hinge 7, and work on the brush 20 without impediments.

Alternatively, if the fixed portion 5 is connected to the segment 21 by means of two screws or handwheels, it is sufficient to remove said screws or handwheels to access the brushes and remove the entire structure 1, hence also in said case the operation is very quick and easy.

During the cleaning of curbs or side walls the brush 20 can be pressed against the same without causing damage to the structure 1, as shown in FIG. 1*b*.

In said case, in fact, the outermost part of the structure 1, consisting of the movable portion 6, rotates on the free hinge 7*b* and returns towards the inside of the machine, taking with it the flexible membrane 2 which momentarily curls up on itself. In the meantime the bristles of the brush 20 are bent against the curb or the area to be cleaned.

At the end of the operation the elastic connection 9 re-sets the movable portion 6 to its original position and the membrane 2 is correctly re-positioned by the oscillating arm 10.

Furthermore, if the structure 1 collides with obstacles or similar, the process described above allows the movable portion 6 to temporarily deform, elastically absorbing the shock. Said elastic deformation is very useful especially when the brush 20 is not being used. During inactivity, the overall dimensions of the brush 20 are smaller than during use, as previously specified. In conditions of inactivity, therefore the structure 1 emerges considerably from the brush 20, but does not constitute an obstacle due to the elasticity and deformability of the movable portion 6.

Furthermore the supporting element 11, appropriately consisting of an elastic element, absorbs shocks and temporary deformations without problems and without sustaining permanent deformations.

After a certain period of use the lower part 2*b* of the membrane 2 wears out due to continuous contact with and dragging on the ground. In said case, to restore full operation of the same, it is not necessary to replace all the membrane 2; it is sufficient to remove and replace the lower part 2*b* of the same which is connected to the membrane by means of movable fixing means such as Velcro or similar.

The invention achieves important advantages.

The structure 1 protects efficiently the brush 20 from the diffusion of dust and similar. It therefore allows the sweeping machines to work without difficulty and to operate perfectly even during dry cleaning.

Furthermore, the structure 1 can be removed very quickly to allow a rapid and easy maintenance of the brushes.

The movable portion 6 allows the brushes 20 to be used against curbs and side walls without damaging the structure 1. Said operation is fundamental for cleaning the edges formed by said kerbs and side walls which are the areas where waste of various types usually accumulates.

Furthermore by means of the transparent membrane 4 it is always possible to check the conditions, operation and, above all, the position of the brushes 20.

The latter characteristic greatly facilitates the operator's work.

The structure 1, furthermore, can be easily and quickly replaced, and likewise the membrane 2.

The presence of the movable portion 6 and the elasticity of the supporting element 11 in particular permit the absorption of any shock without problems.

Last but, not least, is a great advantage that the lower part 2*b* of the structure 1 can be separated from the membrane 2 and therefore quickly and inexpensively replaced.

I claim:

1. Protective structure (1) for brushes of sweeping machines (30), said sweeping machine comprising:

a frame (31) and at least one cup-shaped brush (20) supported by said frame (31) and laterally protruding from said frame (31);

at least one flexible membrane (2) arranged near said cup-shaped brush (20) and suitable to prevent the diffusion of dust in the environment;

a supporting system (3), for said flexible membrane (2) mounted on said frame (31), laterally protruding and movably connected to said frame (31) and comprising a movable portion (6) suitable to shape said flexible membrane (2) and to laterally translate the same toward said frame (31), against the action of the elastic means (9);

a free hinge (7*b*) for connecting said movable portion (6) to said frame (31) and suitable to allow at least partial rotation of said movable portion (6);

a fixed portion (5) suitable to connect said flexible membrane (2) to said frame (31);

a fixed hinge (7*a*) for connecting said fixed portion (5) to said frame (31) and a locking element (8) suitable to constrain the rotation allowed by said fixed hinge (7*a*), said fixed hinge (7*a*) is positioned at one end of said fixed portion (5) and wherein said locking element (8) is a handwheel acting at the opposite end of said fixed portion (5).

2. The protective structure according to claim 1, wherein said fixed hinge (7*a*) and said free hinge (7*b*) are mounted on one single pin.

3. The protective structure according to claim 1, comprising two handwheels for connecting said fixed portion (5) to said sweeping machine.

4. The protective structure according to claim 1, wherein said movable portion comprises a rigid arm (10) and a supporting element (11) consisting of an elastic element.

5. The protective structure according to claim 1, wherein said flexible membrane (2) comprises at least one transparent membrane (4) suitable to allow the viewing of said at least one cup-shaped brushes (20).

6. The protective structure according to claim 1, wherein said flexible membrane (2) comprises a lower part (2*b*) in contact with the ground separable from said protective structure.

7. The protective structure according to claim 6, wherein said lower part (2*b*) is connected to said flexible membrane (2) by means of Velcro.

* * * * *